US011683629B1

(12) United States Patent
Lee

(10) Patent No.: US 11,683,629 B1
(45) Date of Patent: Jun. 20, 2023

(54) EARTIP INCLUDING HYBRID STRUCTURE

(71) Applicant: AZLA Inc., Seoul (KR)

(72) Inventor: Sang Won Lee, Seoul (KR)

(73) Assignee: AZLA Inc., Seoul (KR)

( * ) Notice: Subject to any disclaimer, the term of this patent is extended or adjusted under 35 U.S.C. 154(b) by 0 days.

(21) Appl. No.: 17/977,645

(22) Filed: Oct. 31, 2022

(30) Foreign Application Priority Data

May 9, 2022 (KR) ..... 10-2022-0056524

(51) Int. Cl.
*H04R 25/00* (2006.01)
*H04R 1/10* (2006.01)

(52) U.S. Cl.
CPC ..... *H04R 1/1016* (2013.01); *H04R 1/1058* (2013.01)

(58) Field of Classification Search
CPC .. H04R 1/1091; H04R 1/1016; H04R 1/1041; H04R 1/1083
See application file for complete search history.

(56) References Cited

U.S. PATENT DOCUMENTS

2021/0185429 A1* 6/2021 Smith ..... H04R 1/1091

FOREIGN PATENT DOCUMENTS

| | | | |
|---|---|---|---|
| JP | 2016-181741 | A | 10/2016 |
| KR | 10-1323805 | B1 | 10/2013 |
| KR | 10-2213388 | B1 | 2/2021 |
| KR | 10-2248583 | B1 | 5/2021 |

OTHER PUBLICATIONS

Office Action for KR 10-2022-0056524 dated Jul. 20, 2022.
Notice of Allowance for KR 10-2022-00566524 dated Aug. 31, 2022.

* cited by examiner

*Primary Examiner* — Amir H Etesam
(74) *Attorney, Agent, or Firm* — Sughrue Mion, PLLC

(57) ABSTRACT

Provided is an eartip which stably fixes a position of an earphone and includes a body part that has a hollow cylinder structure corresponding to an outer circumferential surface of the earphone, having a binding groove recessed to a predetermined depth in an annular structure along an inner circumferential surface of the body part, and being made of a first material, an upper end connection part that is formed in an integrated structure with an upper end of the body part, and a lower end formation part that is formed in an integrated structure from a lower end of the umbrella structure formation part, has a hollow cylinder structure extending downward to a predetermined height while surrounding the outer circumferential surface of the body part and spaced a predetermined distance from the outer circumferential surface of the body part.

4 Claims, 9 Drawing Sheets

EARTIP INCLUDING HYBRID STRUCTURE

CROSS-REFERENCE to RELATED APPLICATION

This application claims priority to and the benefit of Korean Patent Application No. 10-2022-0056524 filed on May 9, 2022, the disclosure of which is incorporated herein by reference in its entirety.

BACKGROUND

1. Field of the Invention

The present disclosure relates to an eartip including a hybrid structure, and more particularly to, an eartip including a hybrid structure that significantly reduces a possibility that an ear of a user is injured by adopting a hybrid eartip structure by fusing materials having different properties.

2. Discussion of Related Art

Nowadays, many smartphone users use regular earphones or Bluetooth earphones with a hands-free function for listening to music or phone calls through smartphones.

Usually, when purchasing a smartphone for the first time, bundle earphones are provided in most cases. Compared to over-ear headphones, the earphones may be slightly small in volume but are easy to carry due to their small size. Thus, with the popularity of the smartphones, earphones have become a necessity in our daily life.

The earphones may be roughly classified into open-type earphones and canal-type earphones according to shapes. In early models, open-type earphones were widely used, but now, both the open-type earphones and the canal-type earphones are used in a similar proportion.

The advantage of the open-type earphones is that a speaker module in a housing of the earphone is not completely sealed in an ear canal, and sound is not transmitted directly, and thus a portion of the sound leaks out and the users may feel a comfortable opening feeling. The advantage of the canal-type earphones is that noise is blocked, and when an eartip matched with the width of an inner ear is mounted regardless of the shape of an outer ear that is unique to each person, the canal-type earphones come into contact with ear holes well, and thus the fixing force is strong.

The open-type earphones and the canal-type earphones are complementary to each other. The canal-type earphones are made in an effort to solve the problems of a reduction in low range reproduction ability and introduction of external noise through a fixing force and sound leakage that are the disadvantages of the open-type earphones. In contrast, the canal-type earphones have the functions of the fixing force and noise blocking as opposed to the open-type earphones, but are in close contact with ear canals, and thus air does not circulate well. Therefore, the canal-type earphones are strong in a low range but have the disadvantages of causing a foreign body feeling, stuffiness, and pain depending on each person.

Further, the canal-type earphones are used in a manner in which external noise is minimized by causing speakers and ears to be in close contact with each other as much as possible like over-ear headphones. Thus, since disturbance due to ambient noise is low and sound generated by a diaphragm does not leak to the outside, the canal-type earphones have the advantages that it is possible to listen to music in a place with a poor external environment, that is, a place with severe external noise and disturbance to the surroundings is not caused. However, the canal-type earphones have the disadvantages that, when the canal-type earphones are used for a long time, wearing comfort is relatively low compared to the open-type earphones due to the pressure of the eartips in close contact with the ears, and since the sound of the diaphragm directly affects eardrums, the eardrums may be impacted by the pressure of air.

In order to solve this problem, as illustrated in FIG. 1, a filler 200 is inserted into an inner space of the eartip so that the eartip is in close contact with an ear hole. However, external noise may be partially blocked due to the pressure of the filler, but wearing discomfort is caused, and thus comfortable listening is difficult.

Further, an eartip according to the related art has a structure in which foreign substances generated inside an ear of a wearer are accumulated inside the eartip, and thus has a problems that as a wearing time increases, the inside of the eartip becomes dirty, and sound transmitted from the earphones is not properly transmitted.

As a usage time of the earphones increases, more and more people complain of otitis externa or ear pain. Interest in the eartip and the role of the eartip have become very important.

Thus, a technology that can solve the above-described problems according to the related art is required.

[Related Art Document]

(Patent Document)

(Patent Document 0001) Korean Patent Registration No. 10-1323805 (Registration Date: Oct. 24, 2013)

SUMMARY of the INVENTION

The present disclosure is directed to providing an eartip including a structure that may prevent ear pain and an ear disease from occurring in an ear of a user, and at the same time, may be in close contact with a skin surface of an external auditory canal of a wearer.

An eartip that is mounted on one side of an earphone, is inserted into an external auditory canal of a wearer, and stably fixes a position of the earphone includes a body part that has a hollow cylinder structure corresponding to an outer circumferential surface of an earphone, has a binding groove having a structure recessed by a predetermined depth in an annular structure along an inner circumferential surface of the body part, and is made of a first material, an upper end connection part that is formed in an integrated structure with an upper end of the body part, forms a ring structure along an upper end edge of the body part, connects the body part and an umbrella structure formation part to each other in an integrated structure, and is made of a second material, the umbrella structure formation part that forms a spherical structure protruding from the upper end connection part in a radial form, extending downward to a predetermined height, and extending to surround an outer circumferential surface of the body part and is made of a third material coming into contact with an inner skin of the external auditory canal of the wear, and a lower end formation part that is formed in an integrated structure from a lower end of the umbrella structure formation part, has a hollow cylinder structure extending downward to a predetermined height while surrounding the outer circumferential surface of the body part and spaced a predetermined distance from the outer circumferential surface of the body part, and is made of a fourth material coming into contact with the inner skin of the external auditory canal of the wear.

The first material, the second material, the third material, and the fourth material may be selected from the group consisting of a thermoplastic elastomer (TPE) material, a silicone material, and a polyurethane foam material.

The second material and the fourth material may be different from each other, and the third material and the fourth material may be different from each other.

The body part may include an extension cylinder that has a hollow cylinder structure corresponding to the outer circumferential surface of the earphone and has a side wall extending from the outer circumferential surface of the earphone to a predetermined length to form an inner hollow structure, a stepped ring that is formed in an inner upper portion of the extension cylinder, forms a stepped structure extending from an inner circumferential surface thereof to a predetermined height, continuously formed along the inner circumferential surface, and having a ring structure in a plan view, and is disposed in a boundary line between the upper end connection part and the body part, and a fastening ring that is formed in an inner lower portion of the extension cylinder, has a structure protruding from an inner circumferential surface thereof to a predetermined height and detachably connected to the outer circumferential surface of the earphone, and has a structure forming a ring structure in a plan view.

The eartip may further include an upper end cover part that is mounted on the upper end connection part in a detachable structure, has a cylindrical structure surrounding the umbrella structure formation part, has a structure having the same outer diameter as an outer diameter of the lower end formation part, and is made of a polyurethane foam material coming into contact with a skin surface of the external auditory canal of the wearer.

The lower end formation part may include a partition wall structure that has a structure in which a space between the outer circumferential surface of the body part and the lower end formation part is partitioned into a plurality of spaces, and is formed to protrude from an inner circumferential surface of the lower end formation part to a predetermined height, and an elastic filling member that fills an any space selected among the spaces partitioned by the partition wall structure and is made of a material having an elastic restoring force of a predetermined magnitude.

The partition wall structure may be made of a flexible material that is naturally deformed by pressure of a finger of a user.

The partition wall structure may include a first partition wall that has a plate-shaped structure in which the outer circumferential surface of the body part and the inner circumferential surface of the lower end formation part are connected in one plane, and is provided as a plurality of first partition walls mounted to be spaced apart from each other by a predetermined angle along the outer circumferential surface of the body part, a second partition wall that has a plate-shaped structure in which the plurality of first partition walls are connected to each other and has a curved surface spaced a predetermined distance from the outer circumferential surface of the body part, is provided as a plurality of second partition walls together with the first partition walls mounted to form a hollow cylindrical structure, and a third partition wall that vertically partitions a space defined by the outer circumferential surface of the body part and the inner circumferential surface of the lower end formation part.

The elastic filling member may he made of a silicone gel or polyurethane gel material.

BRIEF DESCRIPTION of the DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION of EXEMPLARY EMBODIMENTS

Hereinafter, embodiments of the present disclosure will be described in detail with reference to the accompanying drawings. Prior to this, the terms or words used in the present specification and the appended claims should not be interpreted as being limited to conventional or dictionary meanings, but should be interpreted as meanings and concepts consistent with the technical spirit of the present disclosure.

Throughout the present specification, when a first member is positioned "on" a second member, this case includes not only a case in which the first member is in contact with the second member but also a case in which a third member is present between the two members. Throughout the present specification, when a part "includes" a component, this means that another component is not excluded but may be further included unless otherwise stated.

Figure 1:
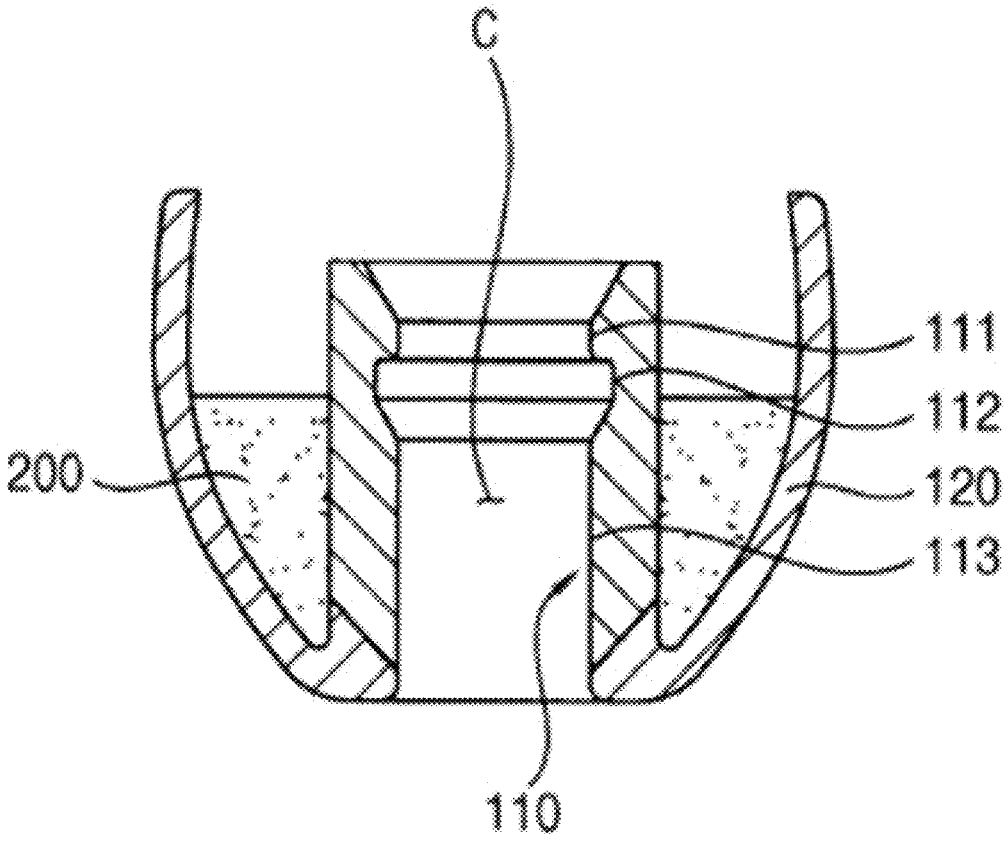
FIG. 1 is a cross-sectional view illustrating an eartip according to the related art.
Figure 2:
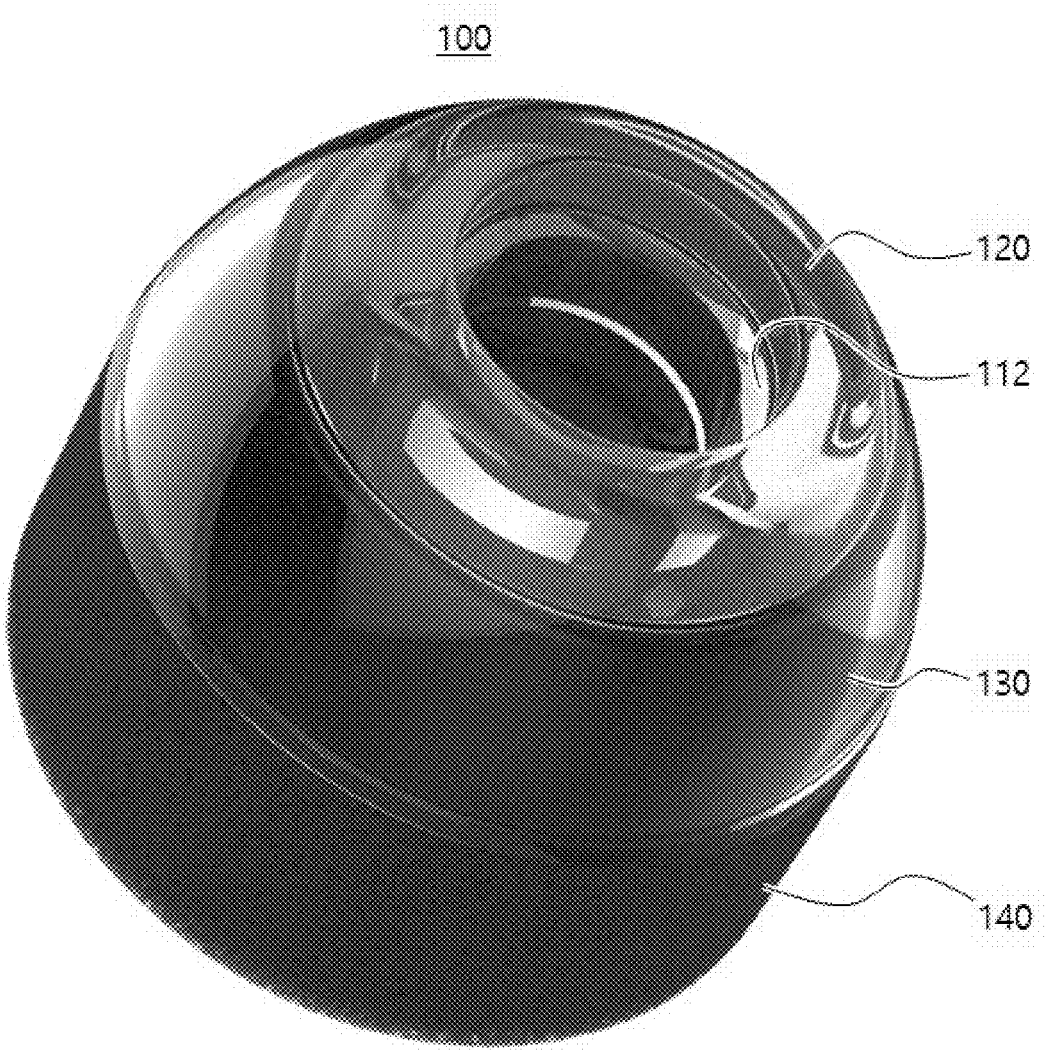
FIG. 2 is a picture illustrating an eartip according to an embodiment of the present disclosure.
Figure 3:
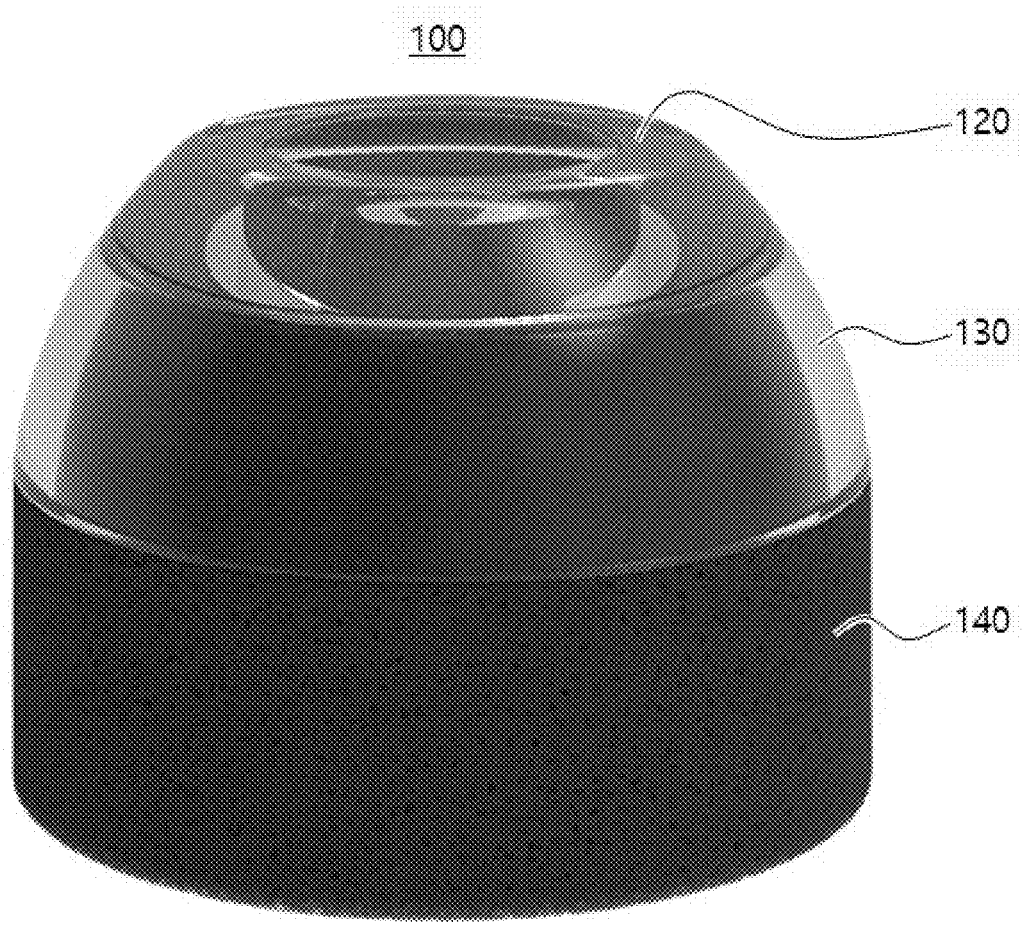
FIG. 3 is a picture illustrating the eartip illustrated in FIG, 2 when viewed from the front side.
Figure 4:
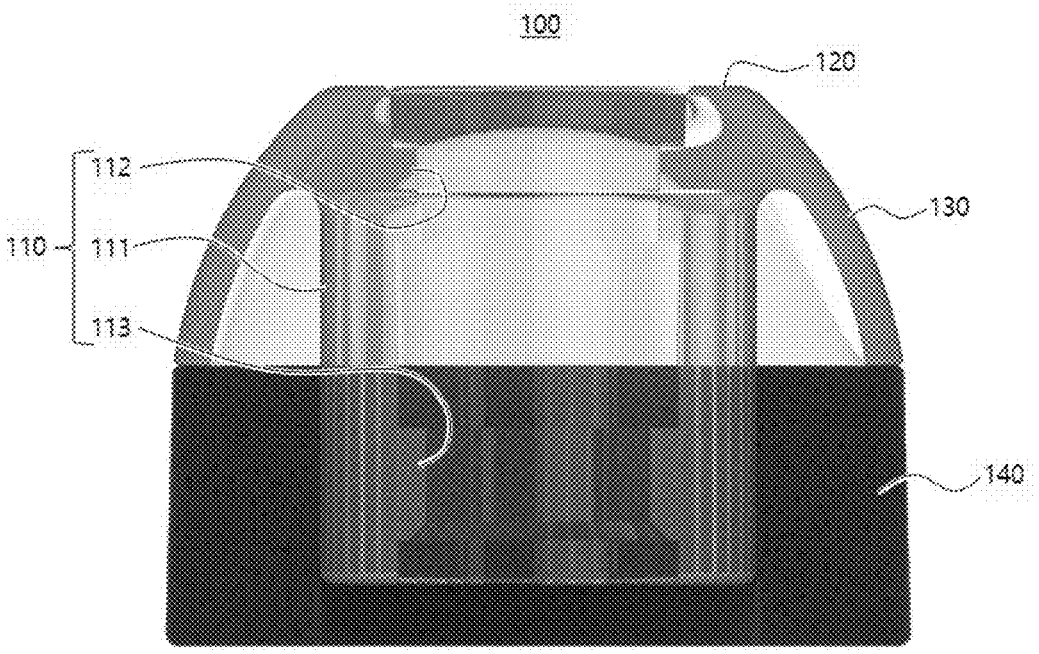
FIG. 4 is a picture illustrating a longitudinal cross section of the eartip illustrated in FIG. 2.
Figure 6:
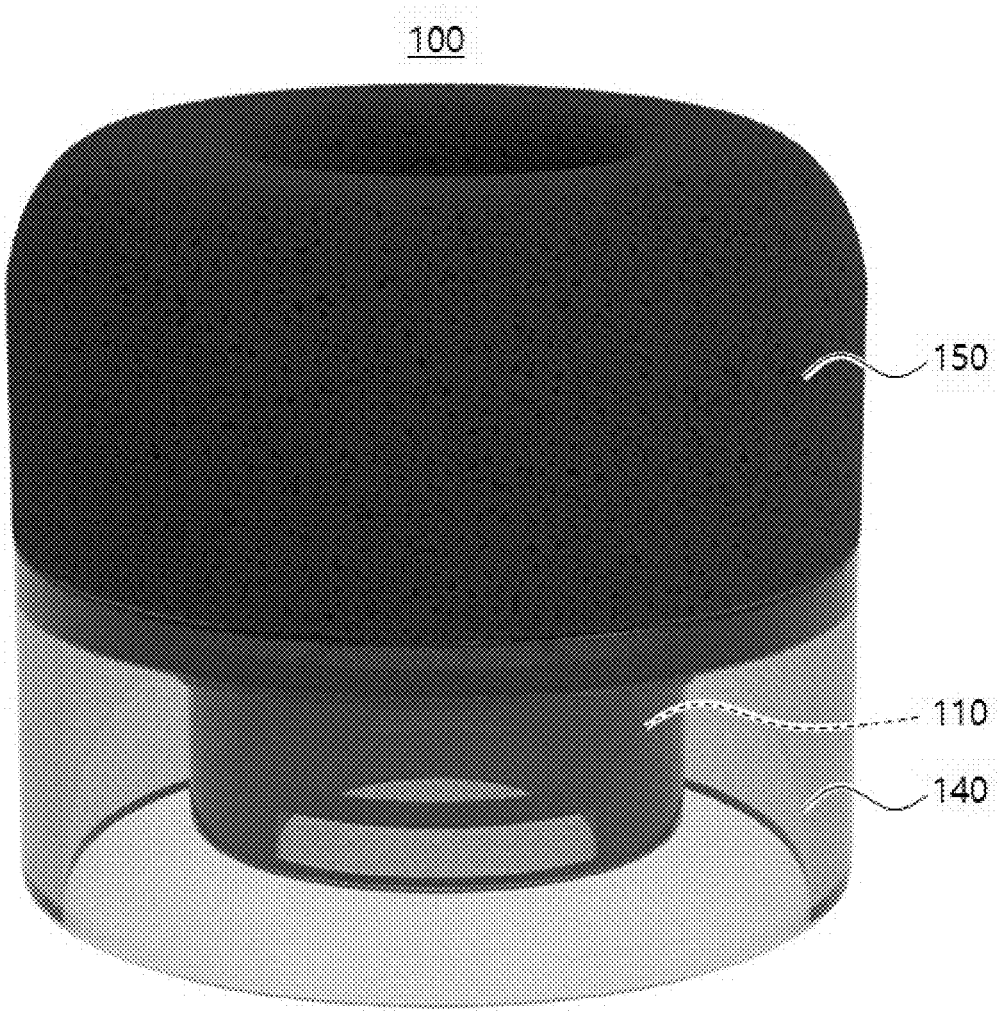
FIG. 6 is a picture illustrating the eartip illustrated in FIG, 5 when viewed from the front side.
Figure 7:
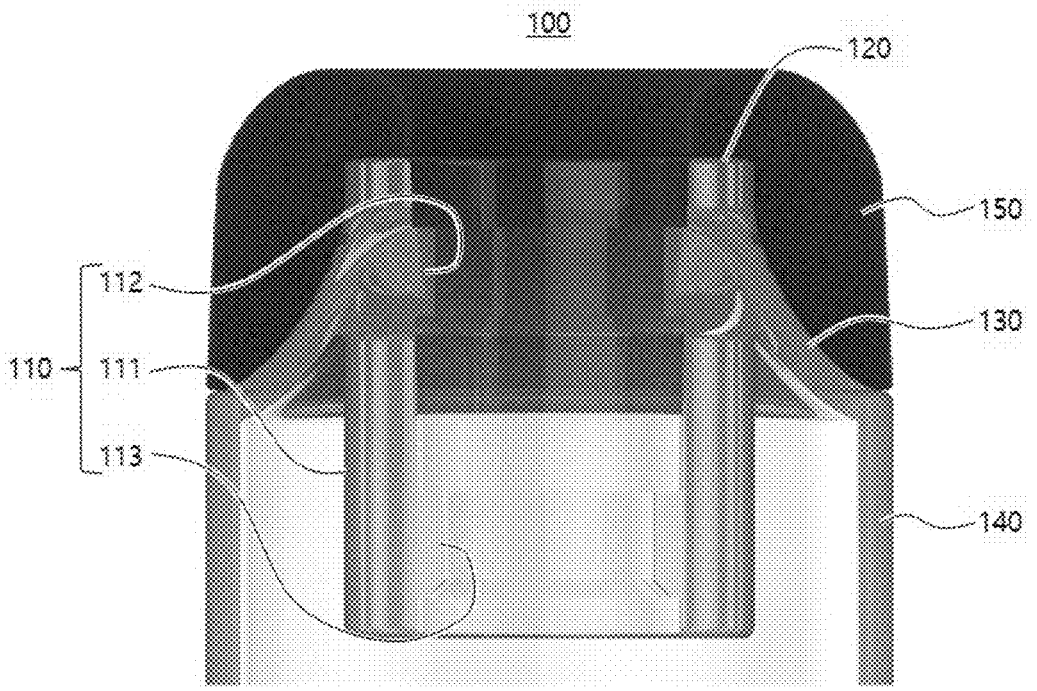
FIG. 7 is a picture illustrating a longitudinal cross section of the eartip illustrated in FIG. 5.

FIG. 2 is a picture illustrating an eartip according to an embodiment of the present disclosure, FIG. 3 is a picture illustrating the eartip illustrated in FIG. 2 when viewed from the front side, and FIG. 4 is a picture illustrating a longitudinal cross section of the eartip illustrated in FIG. 2. Further, FIG. 5 is a picture illustrating an eartip according to another embodiment of the present disclosure, FIG. 6 is a picture illustrating the eartip illustrated in FIG. 5 when viewed from the front side, and FIG. 7 is a picture illustrating a longitudinal cross section of the eartip illustrated in FIG. 5.

Referring to these drawings, an eartip 100 according to the present embodiment is an eartip mounted on one side of an earphone, is inserted into an external auditory canal of a wearer, and stably fix a position of the earphone, and includes a body part, an upper end connection part, an umbrella structure formation part, and a lower end formation part having a specific structure. Further, a thermoplastic elastomer (TPE) material or a silicone material is applied on a surface of the eartip 100 in direct contact with the external auditory canal, a polyurethane foam material is applied on a portion of the eartip 100 that requires a restoring force, and thus problems of an eartip according to the related art that foreign substances inside an ear are accumulated inside a hollow structure of a sponge of the eartip made of a single material according to the related art and thus the inside of the eartip is dirty can be solved. As a result, ear pain and ear disease occurring in the ear of an earphone user can be prevented.

Hereinafter, respective components constituting the eartip 100 according to the present embodiment will be described in detail with reference to the drawings.

Figure 5:
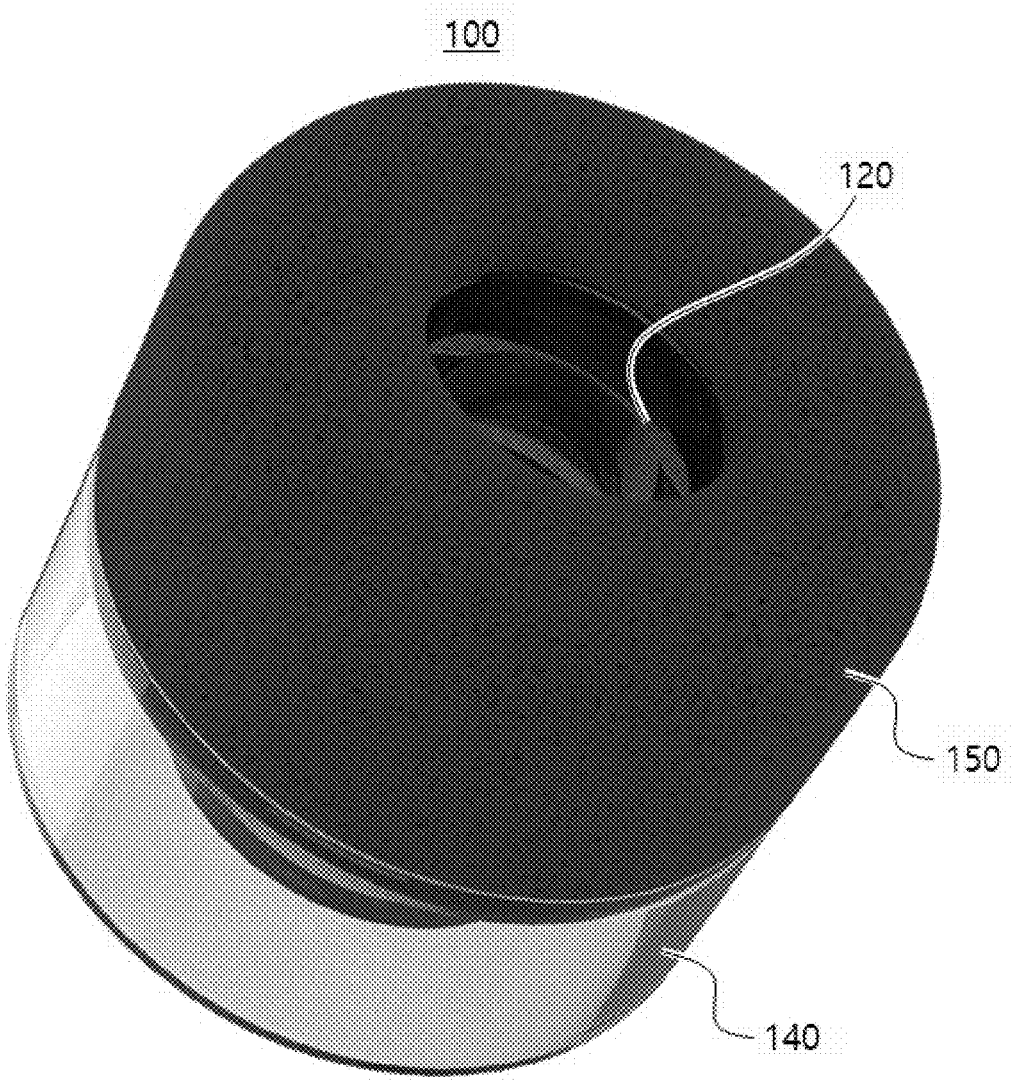
FIG. 5 is a picture illustrating an eartip according to another embodiment of the present disclosure.

As illustrated in FIGS. 4 and 5, a body part 110 of the eartip 100 according to the present embodiment has a hollow cylindrical structure corresponding to an outer circumferential surface of the earphone and has a structure in which a binding groove having a structure recessed to a predetermined depth in an annular structure along an inner circumferential surface is formed. In this case, the body part 110 is made of a first material selected from the group consisting of a TPE material, a silicone material, and a polyurethane foam material. Preferably, the body part 110 may be made of a TPE material or a silicone material.

As illustrated in FIGS. 4 and 5, an upper end connection part 120 according to the present embodiment is integrally formed with an upper end of the body part 110, forms a ring structure along an upper edge of the body part 110, and has a structure in which the body part 110 and an umbrella structure formation part 130 are integrated with each other. In this case, the upper end connection part 120 is made of a second material selected from the group consisting of a TPE material, a silicone material, and a polyurethane foam material. Preferably, the upper end connection part 120 may be made of the same material as the first material of the body part 110.

As illustrated in FIGS. 2 to 4, the umbrella structure formation part 130 according to the present embodiment may form a spherical structure that protrudes from the upper end connection part 120 in a radial form, extends downward to a predetermined height, and extends to surround an outer circumferential surface of the body part 110. In this case, the umbrella structure formation part 130 is in contact with an inner skin of the external auditory canal of the wearer and is made of a third material selected from the group consisting of a TPE material, a silicone material, and a polyurethane foam material. Preferably, the umbrella structure formation part 130 may be made of a material different from a fourth material constituting a lower end formation part 140.

As illustrated in FIGS. 2 to 7, the lower end formation part 140 according to the present embodiment is configured in an integrated structure from a lower end of the umbrella structure formation part 130 and has a hollow cylinder structure that extends downward to a predetermined height in a shape surrounding the outer circumferential surface of the body part 110 and is spaced a predetermined distance from the outer circumferential surface of the body part 110. Preferably, the lower end formation part 140 is in contact with the inner skin of the external auditory canal of the wearer and is made of the fourth material selected from the group consisting of a TPE material, a silicone material, and a polyurethane foam material. Preferably, the lower end formation part 140 may be made of a material different from the third material constituting the umbrella structure formation part 130.

More preferably, the second material and the fourth material described above may be different from each other, and the third material and the fourth material may be different from each other. That is, the materials of the upper end connection part 120, the umbrella structure formation part 130, and the lower end formation part 140 in contact with a skin surface of the external auditory canal of the wearer are differently made of the TPE material tightly in close contact with the skin surface of the external auditory canal, the silicone material smoothly in close contact with the skin surface of the external auditory canal, and the polyurethane foam material softly in close contact with the skin surface of the external auditory canal. Thus, a possibility that pain in the external auditory canal of the wearer occurs can be significantly reduced, and thus a possibility that inflammation is caused can be significantly reduced.

As illustrated in FIGS. 4 and 7, the body part 110 according to the present embodiment may include an extension cylinder 111, a stepped ring 112, and a fastening ring 113 having a specific structure.

In detail, the extension cylinder 111 of the body part 110 according to the present embodiment has a hollow cylinder structure corresponding to the outer circumferential surface of the earphone and is provided with a side wall extending from the outer circumferential surface of the earphone to a predetermined length to form an inner hollow structure. The stepped ring 112 is formed in an inner upper portion of the extension cylinder 111, forms a stepped structure extending from an inner circumferential surface thereof to a predetermined height, continuously formed along the inner circumferential surface, and having a ring structure in a plan view, and has a structure disposed in a boundary line between the upper end connection part 120 and the body part 110. Further, the fastening ring 113 is formed in an inner lower portion of the extension cylinder 111, has a structure protruding from an inner circumferential surface thereof to a predetermined height and detachably connected to the outer circumferential surface of the earphone, and has a structure forming a ring structure in a plan view.

Meanwhile, as illustrated in FIGS. 5 to 7, the eartip up 100 according to the present embodiment may farther include an upper end cover part 150 having a specific structure.

In detail, the upper end cover part 150 is mounted on the upper end connection part 120 in a detachable structure and may have a cylindrical structure surrounding the umbrella structure formation part 130. In this case, it is preferable that the upper end cover part 150 have a structure having the same outer diameter as the outer diameter of the lower end formation part 140 and be made of a polyurethane foam material coming into contact with the skin surface of the external auditory canal of the wearer.

Figure 8:
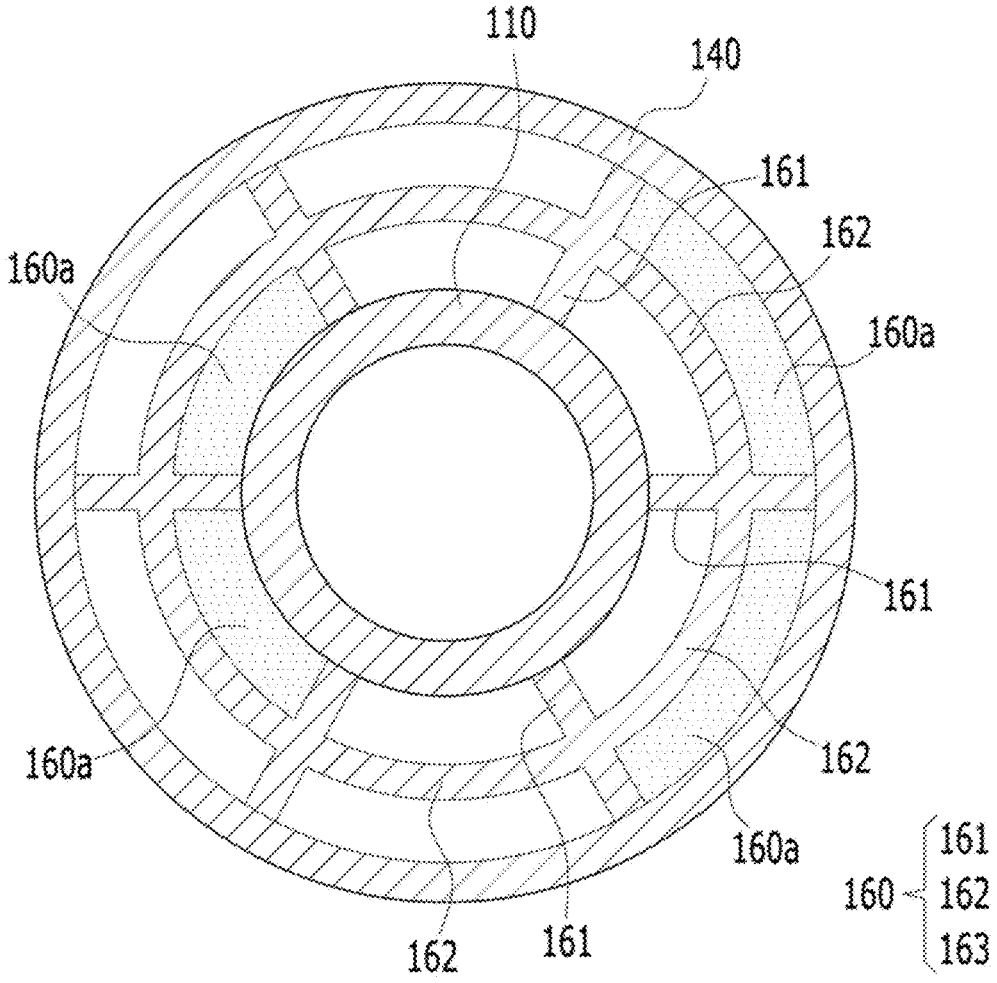
FIG. 8 is a plan view illustrating an eartip according to still another embodiment of the present disclosure; and FIG, 9 is a longitudinal cross-sectional view illustrating the eartip illustrated in FIG. 8.
Figure 9:
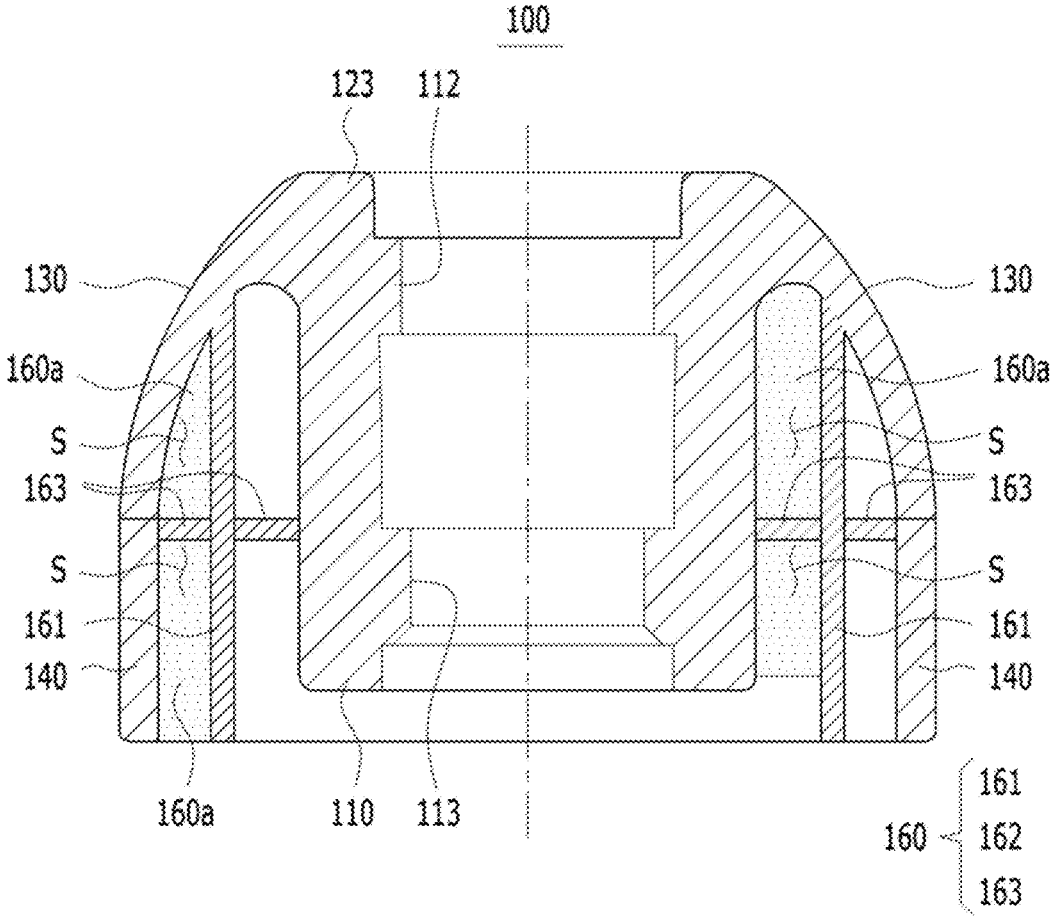

FIG. 8 is a plan view illustrating an eartip according to still another embodiment of the present disclosure, and FIG. 9 is a longitudinal cross-sectional view illustrating the eartip illustrated in FIG. 8.

Referring to the accompanying drawings, the eartip 100 according to the present embodiment may include a partition wall structure 160 and an elastic filling member **160*a*** having a specific structure.

In detail, the partition wall structure 160 has a structure in which a space between the outer circumferential surface of the body part 110 and the lower end formation part 140 is partitioned into a plurality of spaces and has a structure protruding from an inner circumferential surface of the lower end formation part 140 to a predetermined height. Further, the elastic filling member **160*a* fills an any space selected among the spaces partitioned by the partition wall structure 160** and is made of a material having an elastic restoring force of a predetermined magnitude.

In more detail, it is preferable that the partition wall structure 160 according to the present embodiment is made of a flexible material that may be naturally deformed by pressure of a finger of a user. In this case, the partition wall structure 160 may include a first partition wall 161, a second partition wall 162, and a third partition wall 163. The first partition wall 161 has a plate-shaped structure in which the outer circumferential surface of the body part 110 and the inner circumferential surface of the lower end formation part 140 are connected in one plane, and a plurality of first partition walls 161 may be mounted to be spaced apart from each other by a predetermined angle along the outer circumferential surface of the body part 110. The second partition wall 162 has a plate-shaped structure in which the plurality of first partition walls 161 are connected to each other and has a curved surface spaced a predetermined distance from the outer circumferential surface of the body part 110, and a plurality of second partition walls 162 together with the first partition walls 161 may be mounted to form a hollow cylindrical structure. Further, the third partition wall 163 may vertically partition a space defined by the outer circumferential surface of the body part 110 and the inner circumferential surface of the lower end formation part 140. In this case, it is preferable that the elastic filling member 160*a* be made of a silicone gel or polyurethane gel material.

In this case, according to the present embodiment, the eartip including the partition wall structure can be provided in which the partition wall structure including the first partition wall, the second partition wall, and the third partition wall having a specific structure is provided, the elastic filling member fills an any selected space among the spaces formed by the partition wall structure, the eartip comes into close contact with the skin surface of the external auditory canal of the wearer when worn on the ear of the wearer, and thus an active noise canceling function is improved, and ability of block external noise is improved.

As described above, an eartip according to the present disclosure includes a body part, an upper end connection part, an umbrella structure formation part, and a lower end formation part having a specific structure. Further, a thermoplastic elastomer (TPE) material or a silicone material is applied on a surface of the eartip in direct contact with an external auditory canal, a polyurethane foam material is applied on a portion of the eartip that requires a restoring force, and thus problems of the eartip according to the related art that foreign substances inside an ear are accumulated inside a hollow structure of a sponge of the eartip made of a single material according to the related art and thus the inside of the eartip is dirty can be solved. As a result, ear pain and ear disease occurring in the ear of an earphone user can be prevented, and through a structure in close contact with a skin surface of an external auditory canal of a wearer, noise generated from the outside can be prevented from penetrating through the eartip. As a result, the eartip that can prevent ear pain and ear disease, and at the same time, ensure high-quality sound can be provided.

In the above detailed description of the present disclosure, only specific embodiments thereof have been described. However, it should be understood that the present disclosure is not limited to particular forms mentioned in the detailed description, but rather, it should be understood that the present disclosure includes all modifications, equivalents, and substitutions within the spirit and scope of the present disclosure as defined by the appended claims.

That is, the present disclosure is not limited to the specific embodiments and descriptions described above, those skilled in the art to which the present disclosure pertains can implement various modifications without departing from the subject matter of the present disclosure as claimed in the appended claims, and such modifications may he present within the protection scope of the present disclosure.

What is claimed is:

1. An eartip that is mounted on one side of an earphone, is inserted into an external auditory canal of a wearer, and stably fixes a position of the earphone, the eartip comprising:

a body part (110) that has a hollow cylinder structure corresponding to an outer circumferential surface of an earphone, has a binding groove having a structure recessed to a predetermined depth in an annular structure along an inner circumferential surface of the body part, and is made of a first material;

an upper end connection part (120) that is formed in an integrated structure with an upper end of the body part (110), forms a ring structure along an upper end edge of the body part (110), connects the body part (110) and an umbrella structure formation part (130) to each other in an integrated structure, and is made of a second material;

the umbellar structure formation part (130) that forms a spherical structure protruding from the upper end connection part (120) in a radial form, extending downward to a predetermined height, and extending to surround an outer circumferential surface of the body part (110) and is made of a third material coming into contact with an inner skin of the external auditory canal of the wearer; and a lower end formation part (140) that is formed in an integrated structure from a lower end of the umbrella structure formation part (130), has a hollow cylinder structure extending downward to a predetermined height while surrounding the outer circumferential surface of the body part (110) and spaced a predetermined distance from the outer circumferential surface of the body part (110), and is made of a fourth material coming into contact with the inner skin of the external auditory canal of the wearer, wherein the first material, the second material, the third material, and the fourth material are selected from the group consisting of a thermoplastic elastomer (TPE) material, a silicone material, and a polyurethane foam material, the second material and the fourth material are different from each other, and the third material and the fourth material are different from each other.

2. The eartip of claim 1, wherein the body part (110) includes:

an extension cylinder (111) that has a hollow cylinder structure corresponding to the outer circumferential surface of the earphone and has a side wall extending from the outer circumferential surface of the earphone by a predetermined length to form an inner hollow structure;

a stepped ring (112) that is formed in an inner upper portion of the extension cylinder (111), forms a stepped structure extending from an inner circumferential surface thereof by a predetermined height, continuously formed along the inner circumferential surface, and having a planar ring structure, and is disposed in a boundary line between the upper end connection part (120) and the body part (110); and a fastening ring (113) that is formed in an inner lower portion of the extension cylinder (111), has a structure protruding from an inner circumferential surface thereof to a predetermined height and detachably connected to the outer circumferential surface of the earphone, and has a structure forming a ring structure in a plan view.

3. The eartip of claim 1, further comprising an upper end cover part (150) that is mounted on the upper end connection part (120) in a detachable structure, has a cylindrical structure surrounding the umbrella structure formation part (130), has a structure having the same outer diameter as an outer diameter of the lower end formation part (140), and is made of a polyurethane foam material coming into contact with a skin surface of the external auditory canal of the wearer.

4. The eartip of claim 1, wherein the lower end formation part (140) includes:

a partition wall structure (160) that has a structure in which a space between the outer circumferential surface of the body part (110) and the lower end formation part (140) is partitioned into a plurality of spaces, and is formed to protrude from an inner circumferential surface of the lower end formation part (140) to a predetermined height; and an elastic filling member (160*a*) that fills an any space selected among the spaces partitioned by the partition wall structure (160) and is made of a material having an elastic restoring force of a predetermined magnitude, wherein the partition wall structure (160) is made of a flexible material that is naturally deformed by pressure of a finger of a user, the partition wall structure (160) includes:

a first partition wall (161) that has a plate-shaped structure in which the outer circumferential surface of the body part (110) and the inner circumferential surface of the lower end formation part (140) are connected in one plane, and is provided as a plurality of first partition walls (161) mounted to be spaced apart from each other by a predetermined angle along the outer circumferential surface of the body part (110);

a second partition wall (162) that has a plate-shaped structure in which the plurality of first partition walls (161) are connected to each other and has a curved surface spaced a predetermined distance from the outer circumferential surface of the body part (110), and is provided as a plurality of second partition walls (162) together with the first partition walls (161) mounted to form a hollow cylindrical structure; and a third partition wall (163) that vertically partitions a space defined by the outer circumferential surface of the body part (110) and the inner circumferential surface of the lower end formation part (140), and the elastic filling member (160*a*) is made of a silicone gel or polyurethane gel material.

* * * * *